US006202808B1

(12) United States Patent
Sadow

(10) Patent No.: US 6,202,808 B1
(45) Date of Patent: Mar. 20, 2001

(54) ROLLING CASE WITH RADIALLY RECESSED ROLLER

(75) Inventor: Bernard D. Sadow, Chappaqua, NY (US)

(73) Assignee: Outrigger, Inc., Chappaqua, NY (US)

( * ) Notice: Subject to any disclaimer, the term of this patent is extended or adjusted under 35 U.S.C. 154(b) by 0 days.

(21) Appl. No.: 09/362,980

(22) Filed: Jul. 28, 1999

(51) Int. Cl.[7] ..... A45C 5/14; A45C 13/26
(52) U.S. Cl. ..... 190/18 A; 190/39; 190/115
(58) Field of Search ..... 190/115, 39, 18 A

(56) References Cited

U.S. PATENT DOCUMENTS 3,809,231 * 5/1974 Palma et al. ..... 190/18 A X
3,948,365 * 4/1976 Gregg et al. ..... 190/18 A
5,447,216 * 9/1995 Freyvogel ..... 190/19 A

FOREIGN PATENT DOCUMENTS

2005520 * 9/1971 (DE) ..... 190/18 A
3702723 * 2/1988 (DE) ..... 190/18 A
1292341 * 3/1962 (FR) ..... 190/18 A
1539021 * 1/1979 (GB) ..... 190/18 A
2030966 * 4/1980 (GB) ..... 190/18 A

* cited by examiner

*Primary Examiner*—Sue A. Weaver

(57) ABSTRACT

A rolling case is disclosed which includes a rolling apparatus, such as an elongated roller assembly, along its bottom wall and an extensible handle which may be moved above the top wall when it is desired to utilize the case in its rolling mode of operation. The rolling apparatus is recessed from an edge of the bottom wall so that it will not contact the ground surface when the case is being maintained in a stationary mode on the ground surface. The elongated roller assembly may preferably be manually removed and has an intermediate support.

14 Claims, 2 Drawing Sheets

ROLLING CASE WITH RADIALLY RECESSED ROLLER

FIELD OF THE INVENTION

This invention relates to a rolling carrying case which includes a rolling means, such as an elongated roller along an edge of its bottom wall, and an extensible handle above the top wall for rolling the case along a ground surface.

BACKGROUND OF THE INVENTION

A plurality of luggage cases are known which may be readily converted from a manual carrying mode of operation to a rolling mode of operation when it is desired to extensively traverse a ground surface. A rolling means, which may be in the form of individual wheels or an elongated roller assembly, is located along, and depends downwardly from, the bottom wall. When it is desired to operate the rolling case in its rolling mode of operation, an extensible handle is moved above the top wall, grasped by the user, and the case is tilted backwards to provide appropriate engagement between the rolling means and ground surface without an interference relationship with respect to other portions of the bottom wall. The bottom wall may also typically include a plurality of feet downwardly extending therefrom. The feet are positioned to support the case on the ground surface in its stationary mode of operation, with the bottom surface being generally parallel to the ground surface.

The wheels, or other form of rolling means, provided along the bottom surface have, in prior cases, generally depended downwardly an amount greater than the length of the supporting feet. Thus when such prior cases are in their stationary mode of operation and supported by the depending feet, the rolling means has also been in contact with the ground surface. This disadvantageously can affect the stability of the rolling case, particularly if it is on an inclined surface, while the case is being maintained in its stationary mode of operation.

SUMMARY OF THE INVENTION

In accordance with the present invention the rolling means which is carried at the bottom edge of the case is predeterminedly inwardly recessed from the edge of the case such that the outer periphery of the rolling means will be spaced away from the ground surface when the case is in its stationary mode of operation. When it is desired to convert the case to its rolling mode of operation, the extensible handle is grasped and the case is tilted back to provide the necessary engagement between the rolling means and ground surface. Thus the rolling means of the present invention is predeterminedly spaced with respect to the edge of the bottom wall of the case such that it will not contact the ground surface, and disadvantageously affect its stability, while the case is in its stationary mode of operation.

The rolling means, which is preferably in the form of an elongated roller assembly which extends substantially along the entire length of a bottom edge of the case, has a radius appropriately coordinated with the radius of the bottom edge of the case, and the axial mounting of the elongated roller assembly to provide the requisite radial recessing of the rolling means to prevent contact with the case is in its stationary mode of operation.

The radial recession of the rolling means also advantageously provides a smoother and overall more aesthetically desirable case silhouette, compared to a case in which there is a greater projection of the rolling means beyond the periphery of the walls of the case.

As a further advantageous feature of the present invention, when the rolling means is in the form of an elongated roller assembly it may be advantageously manually removed from the case, should it be necessary to remove debris from the roller assembly or replace a damaged roller assembly. The removable elongated roller assembly may be secured to the case by a spring biasing means which may be readily manually defeated when it is desired to remove the elongated roller assembly from the bottom of the case.

As a further advantageous feature of the present invention, when the rolling means is in the form of an elongated roller assembly that extends substantially along the entire length of the bottom edge of the case, an intermediate roller support member is provided. The intermediate roller support member engages an intermediate section of the roller axis to prevent distortion thereof at the center region.

It is therefore a primary object of the present invention to provide a rolling case in which the roller at the bottom of the case will be spaced from the ground surface when the case is in its stationary, non-rolling, mode of operation.

A further object of the present invention is to provide such a rolling carrying case which includes a plurality of downwardly extending feet for supporting the case in its stationary mode of operation, with the feet extending downward from the bottom wall of the case an amount greater than the downward extent of the roller when the case is in its stationary mode of operation.

Yet a further object of the present invention is to provide such a rolling case in which the rolling means is in the form of an elongated roller assembly mounted to a bottom edge of the case, and extending substantially along the entire length thereof.

Yet another object of the present invention is to provide such a rolling case in which the elongated roller assembly may be manually removed therefrom for cleaning or replacement.

Still another object of the present invention is to provide such a case which includes an elongated roller assembly which extends along substantially the entire length of a bottom edge of the case, and includes an intermediate support.

These as well as other objects of the present invention will become readily apparent upon a consideration of the following description and drawings:

DETAILED DESCRIPTION OF THE PREFERRED EMBODIMENTS

Figure 1:
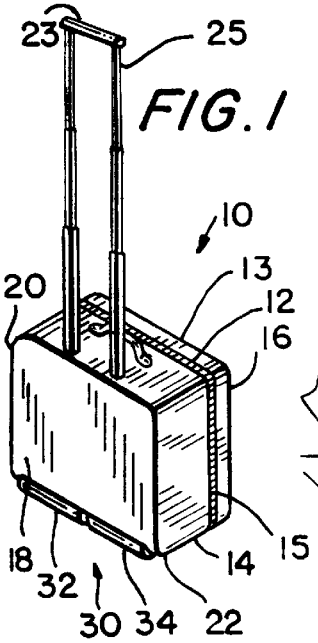
FIG. 1 is a perspective view of a rolling carrying case incorporating the present invention.
Figure 2:
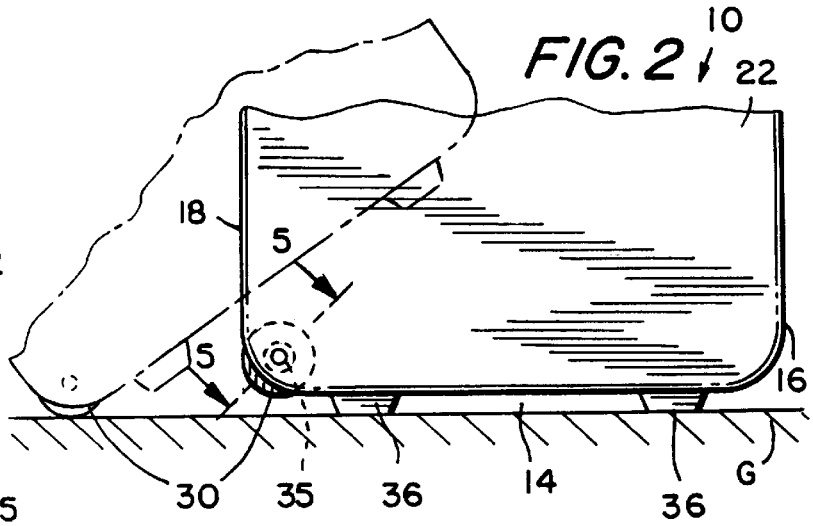
FIG. 2 is a detailed front view of the lower portion of the carrying case shown in the stationary mode of operation, and the rolling mode of operation being shown in dot/dash.
Figure 3:
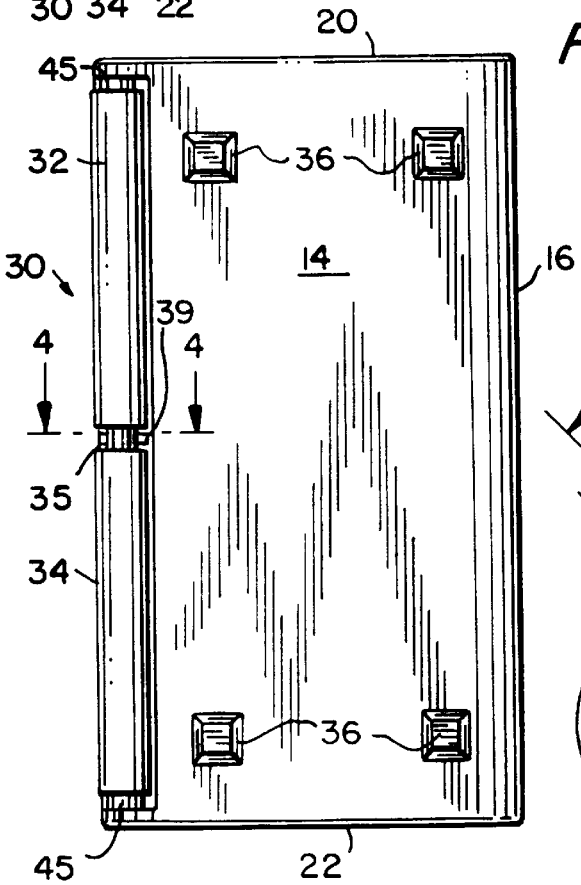
FIG. 3 is a bottom view of the case.

Referring initially to FIGS. 1–3 the rolling carrying case 10 includes opposed top and bottom walls 12, 14; front and back walls 16, 18; and end walls 20, 22. These external walls collectively define an enclosed volume for the reception and removal of contents. An access means, such as zipper 15, may be provided for the opening of the case to permit access to its enclosed volume when it is desired to insert or remove contents therefrom.

The aforedescribed walls of the case are preferably formed of a soft but rugged fabric material, such as canvas, vinyl, or leather, with such materials being illustrative of the numerous types of materials that may be used to form such carrying cases. A manual handle 13 is provided along the top wall 12 when it is desired to lift and manually carry the case. If desired, additional shoulder straps (not shown) may be provided should it be desired to manually carry the case over the user's shoulders.

A retractable handle assembly 25 of the well known variety is extendable above the top wall 12. Retractable handle assembly 25 preferably includes a plurality of telescoping sections which may be telescoped downwardly into the case when it is desired to utilize the case in its manual carrying, non-rolling, mode of operation. A rolling means 30 is mounted to an edge of the case at the juncture of bottom wall 14 and rear wall 18. Rolling means 30 is shown as an elongated roller assembly having coaxial sections 32, 34 rotatably mounted about axis 35. It should however be understood that although an elongated roller 30 is shown extending substantially along the entire length of a bottom edge of case 10, alternatively a plurality of individual wheels may be spaced along this edge.

A plurality of downwardly extending feet 36 are also provided about the bottom surface 14, preferably four in number, in juxtaposition of each corner of the bottom wall 14.

As shown in FIG. 2, when it is desired to rest the case on the ground surface G the feet 36 will be in contact with the ground surface, with bottom wall 14 being substantially parallel thereto. When it is desired to roll the case along the ground surface G, the handle 23 of handle assembly 25 is manually grasped, and the case tilted backwards with the rolling means 30 traversing along the ground surface G.

In accordance with the present invention the rolling means 30, and its mounting edge of bottom wall 14, are dimensionally related such that when the carrying case 10 is in its stationary mode of operation, and feet 36 are contacting the ground surface, the rolling means 30 will not be in contact engagement with the ground surface G. This provides increased stability in the stationary mode of operation, particularly if it is desired to rest the stationary case on an inclined surface. Further, by minimizing the outward projection of the rolling means 30 from the edge of the case a smoother, more pleasing case silhouette is formed.

In providing the appropriate inward recess of the roller means 30 such that its outer periphery will be spaced away from the ground surface G, when the case is in its stationary mode of operation, the bottom edge of the case where the roller assembly 30 is mounted has a radius R1. This radius is greater than the radius R2 of the roller assembly 30 (see FIG. 4).

While not intended to be limiting of the present invention, the following are representative of the preferred embodiment thereof:

R1=2 inches

R2=¾ inch

In accordance with an advantageous feature of the present invention, the roller assembly may include an intermediary support 39 which engages the axis 35 at the medial juncture of roller members 32 and 34.

Figure 5:
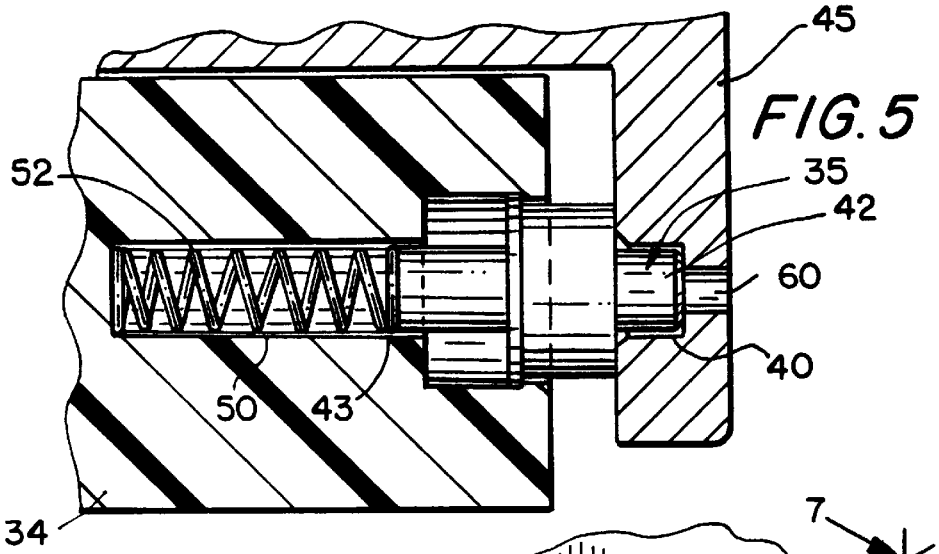
FIG. 5 is a cross sectional view along the line 5—5 as shown in FIG. 2 and looking in the direction of the arrows.
Figure 6:
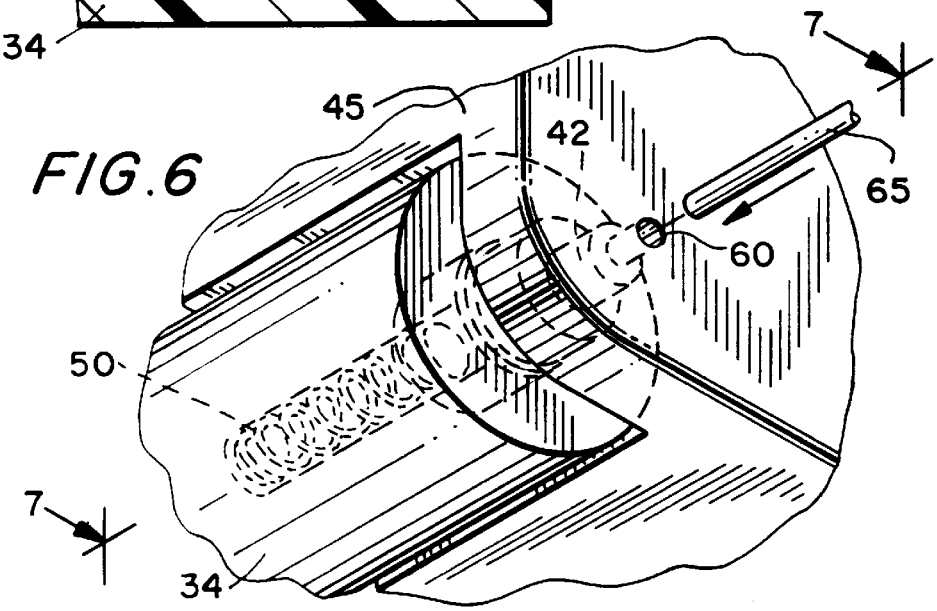
FIG. 6 is an exploded perspective view showing a detail of one end of the removable roller assembly shown in FIG. 5.
Figure 7:
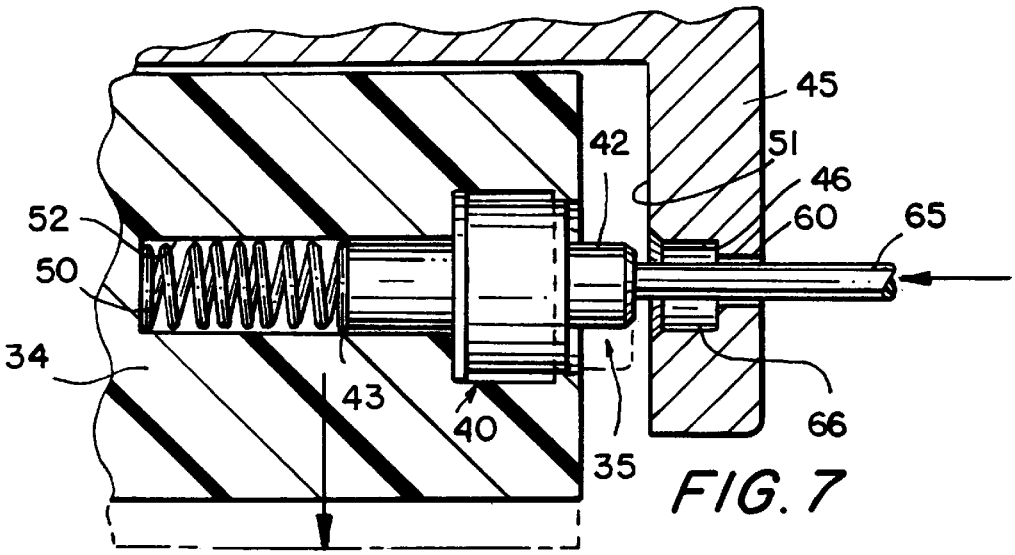
FIG. 7 is a cross sectional view as shown by the line 7—7 in FIG. 6 and looking in the direction of the arrows.

Referring now to FIGS. 5 through 7, as an additional advantageous feature of the present invention the elongated roller assembly 30 may be manually removed from the case. Such manual removal advantageously permits the replacement of a damaged elongated roller assembly, which could occur after prolonged use, striking of an object, or dropping of the case. Further, small rocks or other debris could accumulate within the elongated roller assembly 30 detracting from its proper functioning. Such debris can more readily be removed by the manual disassembly of elongated roller 30.

To readily permit such manual removal and replacement of the elongated roller assembly 30, each of its individual rollers sections 34, 32 is mounted at its free end to bracket member 45, with the connection of one such roller section 34, being shown in FIGS. 5–7. It is naturally understood that the free end of the other roller section 32 is similarly mounted to the opposed end of bracket 45. The axis 35 of roller 34 includes a spring biased member 40 which includes neck down portion 42 which, during installation of the roller assembly will be within cooperating aperture 46 of bracket 45. The opposite end 43 of member 40 abuts expansion spring 50 which is within opening 52 of roller 34 and biases member 40 outward to firmly seat portion 42 within aperture 46 of bracket 45. A small opening 60 is provided within bracket 45 for the insertion of a pin 65 to release the roller section 34 from bracket 45. Pin 65 is manually inserted and will abut wall 66 against the force of expansion spring 50 to release the engagement of portion 42 within bracket aperture 46. This will then permit removal of the cylindrical elongated roller, as the opposed end of the other roller section 32 is similarly released from bracket 45. It should naturally be understood that other structures for manual removal of the elongated roller assembly may be utilized, with FIGS. 5–7 being exemplary of one such arrangement.

Figure 4:
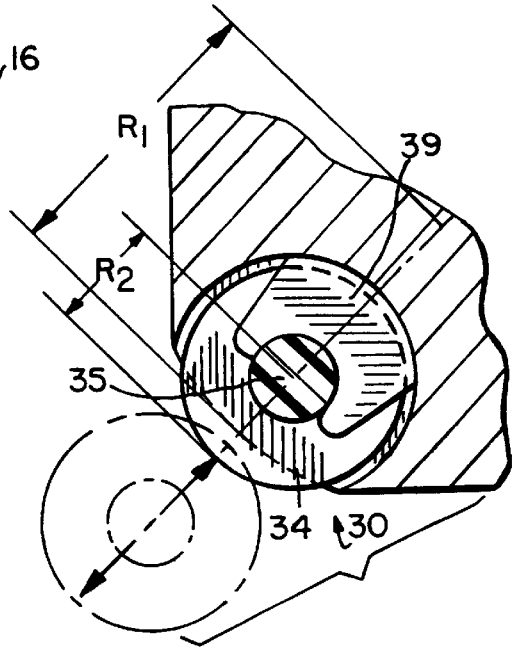
FIG. 4 is a cross sectional view along the line 4—4 as shown in FIG. 3 and looking in the direction of the arrows.

The intermediate support of the roller assembly axis 35, as shown in FIG. 4, is configured in a manner which while providing the requisite support will not prevent the desired manual removal of the roller assembly as shown in FIGS. 5–7.

While the present invention has been described in conjunction with the preferred embodiment, it should naturally be understood that this is for illustrative purposes only and various modifications may be made thereto without departing from the spirit and scope of the invention which is defined by the appended claims.

I claim:

1. In a rolling carrying case comprising a plurality of walls collectively defining an enclosed volume for the reception and removal of contents, said walls including opposed top and bottom walls, rolling means mounted to said bottom wall, and handle means extendible above said top wall for the rolling of said case along a ground surface, said bottom wall further including a plurality of downwardly extending feet;

said case having stationary and rolling modes of operation, said stationary mode of operation characterized as said feet contacting the ground surface and supporting the case with said bottom wall being substantially parallel to the ground surface, and said rolling mode of operation characterized as said bottom wall being tilted with respect to the ground surface, with the user manually grasping said handle means and said rolling means contacting the ground surface for traversing along the ground surface;

the improvement comprising:

said rolling means being mounted along a first edge of said bottom wall, said rolling means being predeterminedly inwardly recessed from said first edge towards said enclosed volume, said rolling means being positioned such that the outer periphery of said rolling means does not project outwardly of a plane in which a portion of said first edge lies, said rolling means being positioned such that said outer periphery of said rolling means will be spaced away from the ground surface when said case is in its stationary mode of operation, and will be in rolling contact with the ground surface when said case is tilted to its rolling mode of operation.

2. In a rolling carrying case according to claim 1, wherein said first edge has a first radius, said rolling means includes an axis extending along and radially inward of said first edge, said rolling means has a second radius about said axis;

said first radius being greater than said second radius, with the outer periphery of said rolling means extending beyond the outer periphery of said first radius a first amount;

said feet extending downward of said bottom wall a second amount, said second amount being greater than said first amount.

3. In a rolling carrying case according to claim 2, wherein said axis is inwardly recessed from the outer periphery of said first edge by an amount less than said first radius.

4. In a rolling carrying case according to claim 2, said rolling means is an elongated roller assembly extending substantially along the entire length of said first edge, and further including an intermediate support member along said first edge in engagement with an intermediate section of said axis for providing intermediate support for said elongated roller assembly.

5. In a rolling carrying case according to claim 4, further including roller mounting means for removably mounting said elongated roller assembly to said first edge, and said roller support member is removably connected to said axis.

6. In a rolling carrying case according to claim 1, wherein said rolling means is an elongated roller assembly extending substantially along the entire length of said first edge.

7. In a rolling carrying case according to claim 6, further including roller mounting means for removably mounting said elongated roller assembly to said first edge.

8. In a rolling carrying case according to claim 7, wherein said roller mounting means includes manually operable disassembly means for disassembling said elongated roller assembly from said first edge.

9. In a rolling carrying case comprising a plurality of walls collectively defining an enclosed volume for the reception and removal of contents, said walls including opposed top and bottom walls, rolling means mounted to said bottom wall, and handle means extendible above said top wall for the rolling of said case along a ground surface;

said case having stationary and rolling modes of operation, said stationary mode of operation characterized as said case being supported on the ground with said bottom wall being substantially parallel to the ground surface, and said rolling mode of operation characterized as said bottom wall being tilted with respect to the ground surface, with the user manually grasping said handle means and said rolling means contacting the ground surface for traversing along the ground surface;

the improvement comprising:

said rolling means being mounted to said bottom wall and predeterminedly inwardly recessed from the outer periphery of said bottom wall towards said enclosed volume, said rolling means being positioned such that the outer periphery of said rolling means does not project outwardly of a plane in which a portion of an outer surface of said bottom wall lies, said rolling means being positioned such that said outer periphery of said rolling means will be spaced away from the ground surface when said case is in its stationary mode of operation, and will be in rolling contact with the ground surface when said case is tilted to its rolling mode of operation.

10. In a rolling carrying case according to claim 9, wherein said rolling means is an elongated roller assembly extending substantially along the entire length of an edge of said bottom wall.

11. In a rolling carrying case according to claim 10, further including roller mounting means for removably mounting said elongated roller assembly to said edge.

12. In a rolling carrying case according to claim 11, wherein said roller mounting means includes manually operable disassembly means for disassembling said elongated roller assembly from said edge.

13. In a rolling carrying case according to claim 10, further including an intermediate support member along said edge in engagement with an intermediate section of said elongated roller assembly for providing intermediate support for said elongated roller assembly.

14. In a rolling carrying case according to claim 13, further including roller mounting means for removably mounting said elongated roller assembly to said edge, and said roller support member is removably connected to the axis of said elongated roller assembly.

* * * * *